US008230532B2

(12) United States Patent
Htay et al.

(10) Patent No.: US 8,230,532 B2
(45) Date of Patent: Jul. 31, 2012

(54) REPLACEMENT FITTING FOR TOILET FLUSH VALVES

(76) Inventors: Win Htay, Temple City, CA (US); Michael Lin, Playa Del Rey, CA (US)

( * ) Notice: Subject to any disclaimer, the term of this patent is extended or adjusted under 35 U.S.C. 154(b) by 443 days.

(21) Appl. No.: 12/414,767

(22) Filed: Mar. 31, 2009

(65) Prior Publication Data

US 2009/0255042 A1 Oct. 15, 2009

Related U.S. Application Data

(60) Provisional application No. 61/043,822, filed on Apr. 10, 2008, provisional application No. 61/044,623, filed on Apr. 14, 2008.

(51) Int. Cl.
*E03D 1/35* (2006.01)

(52) U.S. Cl. ..... 4/392; 4/393

(58) Field of Classification Search ..... 4/392, 393, 4/403, 404, 661, 382, 378
See application file for complete search history.

(56) References Cited

U.S. PATENT DOCUMENTS 4,639,951 A * 2/1987 Lamot ..... 4/392
5,138,725 A * 8/1992 Fernstrum, Jr. ..... 4/393
2008/0217150 A1* 9/2008 Chen et al. ..... 200/329

* cited by examiner

*Primary Examiner* — Brian Glessner
*Assistant Examiner* — Paola Agudelo
(74) *Attorney, Agent, or Firm* — Fulwilder Patton LLP

(57) ABSTRACT

The device of the present invention comprises a limiting face configured to limit a movement of a stop arm of a toilet flush system actuator unit, that may be mounted to a toilet flush valve body by at least one retention piece. A fulcrum piece may also be provided, the fulcrum piece including a fulcrum hole adaptably sized to receive a fulcrum pin of a toilet flush system actuator unit, such that when the device is installed on a broken toilet flush valve the device will substitute, or provide support, for the support arms with fulcrum holes and stop tab for the toilet tilt valve.

5 Claims, 6 Drawing Sheets

REPLACEMENT FITTING FOR TOILET FLUSH VALVES

CROSS-REFERENCES TO RELATED APPLICATIONS

This application claims priority from U.S. Provisional Application No. 61/043,822, filed Apr. 10, 2008 and U.S. Provisional Application No. 61/044,623, filed Apr. 14, 2008, both are incorporated by reference in its entirety.

BACKGROUND

A typical tank-style, gravity flow toilet comprises a tank and a bowl with the bowl sitting atop a sewage pipe. The purpose of the tank is to receive and store a quantity of water for flushing the toilet. A flush valve assembly is disposed in the tank, and includes an inlet tube that allows water under pressure to flow into the tank, to a predetermined level. A toilet flush valve is disposed in the tank and, when operated, allows the quantity of water stored in the tank to be delivered to the bowl for flushing the toilet. A typical flush valve assembly includes a "flapper-type" flush valve, including an rotatable actuator unit with a disc-like "flap" which closes off an end of a discharge pipe. A toilet flush lever controls the operation of the flush valve. The flush valve assembly is mounted in the toilet tank by means of, for example, an externally threaded discharge tube passing through the center hole at the bottom of the toilet tank and secured from the external bottom of the toilet tank by a nut. A sealing gasket sandwiched between the top collar of the discharge tube and the toilet tank bottom ensures that water does not leak from the bottom hole of the tank. One problem with traditional flush valve assemblies is that if any portion of the flush valve assembly breaks or no longer functions properly, the toilet must be drained and disassembled and then the assembly must be replaced. Often this includes turning off the main water line feeding the water supply to the toilet or bathroom.

FIGS. 1A-1C depict a typical American Standard Flush Valve. This style of valve is one of the more common flush valve systems in operation today and is used herein for exemplary purposes only. When the toilet flush lever (not shown) is operated, the lift chain (not shown) pulls at a hole 101 of the actuator unit 100, which tilts about its' fulcrum pins 102 in the fulcrum holes 103 of the support arms 104. A curved stop arm 105 on actuator unit 100, bears against a stop tab 106 on the valve body of the assembly 120, thus preventing actuator unit 100 from tilting back beyond its designed limit. With actuator unit 100 tilted, the water in the toilet tank flows through the large exposed seat 110, thus flushing the toilet. As the water level in the toilet tank lowers from this flushing action, the float controlled fill valve or ball cock (not shown) starts introducing water into the toilet tank while the water in the open cylinder 112 of actuator unit 100 empties out through the small hole 114 at the bottom of open cylinder 112. As the water in the toilet tank empties out from flushing, the tilted valve actuator 100 loses its equilibrium due to the depletion of the water through small hole 114 in the bottom of hollow cylinder 112, and the weight of the counterweight 116 and sealing disc 118 forces actuator 100 to tilt back down and seal off the seat 110. The make up water issuing from the toilet fill valve starts filling up the toilet tank and stops when it reaches the level set by the float of the filling valve (not shown). The toilet tank is now ready for the next flush. To enable operation of actuator unit 100, (1) the two support arms 104 with fulcrum holes 103 allow actuator unit 100 to tilt about, and (2) stop tab 106 on the valve body 120 of the flush valve assembly which prevents actuator unit 100 from tilting back beyond its designed limit, are essential components. These two members, support arms 104 and stop tab 106, are often manufactured from plastic materials and frequently break off during normal use, requiring that the toilet tank be dismounted from the toilet so that a new flush valve body 120, including overflow pipe 122, may be installed. In the process of renewal, the gasket between the toilet and tank plus the tank to bowl securing kit has to be renewed. This repair process is messy, costly, and time consuming.

Some alternatives have been introduced, such as redesigning the toilet flapper valve to overcome the need for renewing the flush valve body. The redesigned flapper valve option requires that the toilet flush lever be altered from a short arm type to a long arm type as the flapper needs to be raised from a vertical direction, whereas the tilt valve is rotated by a lateral force. Also, when the flapper valves is mounted on the overflow pipe 122 of the flush valve body 120 such as by a gripping mechanism around the overflow pipe 122, it tends to misalign relative to the seat 110 of the flush valve. The flapper valve arms being of rubber also tend to get warped with usage and disturb the alignment of the flapper valve with the valve seat, unlike the tilt valve which always seats positively. This leads to a toilet that doesn't quite seal properly due to the flapper not being able to seal the toilet flush valve seat fully, causing water to constantly run through the system. This is a common phenomenon known in the trade that not only causes nuisance noise but also wastes water.

Thus there is a need in the art for a device that easily replaces the damaged parts on a toilet flush system and that can readily perform the functions of a damaged and/or broken support arm(s) or stop tab on the valve body of a toilet flush system.

SUMMARY OF THE INVENTION

A limiting element for repair of a toilet flush system is disclosed. The limiting element preferably comprises a limiting face configured to limit a movement of a stop arm of a toilet flush system actuator unit, and at least one retention piece configured to secure the limiting element to a toilet flush valve body. The limiting element may also be removably mounted on the toilet flush valve body.

At least one fulcrum piece may be associated with the limiting element. In such embodiments the at least one fulcrum piece has a fulcrum hole adaptably sized to receive a fulcrum pin of a toilet flush system actuator unit. Embodiments of the limiting element may further comprise a flange associated with the fulcrum piece, the flange being configured to enclose at least a portion of the fulcrum pin when the fulcrum pin is received into the fulcrum hole.

The at least one retention piece may be configured to grip a portion of at least one support arm of a toilet flush valve body to secure the limiting element to a toilet flush valve body, providing there is ample structure on the damaged support arm to grip. The limiting element may also be in the form of a clip or, in some embodiments, a sleeve that completely surrounds the support arm. The limiting element preferably comprises two retention pieces, however, in some embodiments, the limiting element may comprise only one retention piece and may also include more than two. The retention pieces are each preferably configured to grip a portion of one of a pair of support arms of a toilet flush valve body. Disposed between the retention pieces is a limiting face. The limiting face is configured to be positioned flush against a portion of a bridge material disposed between the pair of support arms of the toilet flush valve body.

In some embodiments the limiting element will be molded into a finished component. Although, in such embodiments the material of the component may be selected from a group of materials comprising plastic, metal, or metal alloy, other materials may be used so long as the finished product is rigid enough to carry out the functions disclosed herein, and is corrosion resistant to prevent premature damage due to submersion in water. In other embodiments the limiting element is formed from a lamina sheet. The sheet material is preferably comprised of sheet metal, aluminum, or metal alloy such that the lamina sheet can be formed in the manner herein described. Other similar rigid pliable and corrosion resistant materials are also envisioned.

To form the device of the invention the lamina sheet is folded in a manner such that the limiting element comprises: a) two retention arms each formed from the ends of the lamina sheet, the retention arms each comprising an inner wall, wherein each inner wall is parallel and facing an opposing inner wall, an outer wall, a rear edge, and a front edge, the front edge terminating at an edge of the lamina sheet; and b) a bridge surface formed from a middle portion of the lamina sheet.

In some embodiments the device of the present invention is configured to be removably mounted on the toilet flush valve body by sliding the two retention arms over respective support arms of the toilet flush valve body in a manner such that when the limiting element is mounted on the toilet flush valve body each of the two retention arms substantially surround a portion of a respective support arm and a face of the bridge surface is substantially flush against a portion of a bridge material of the toilet flush valve body disposed between the two support arms, and the bridge material is substantially tightly sandwiched between the face of the bridge surface and the front edge of each retention arm. In some embodiments, the limiting element is configured to be removably mounted on the toilet flush valve body by sliding the two retention arms over respective support arms of the toilet flush valve body in a manner such that when the limiting element is mounted on the toilet flush valve body each inner wall is configured to closely follow a profile of a portion of a respective support arm of the toilet flush valve body to provide fulcrum holes for receiving respective fulcrum pins of the toilet flush system actuator unit.

A proximal portion of each inner wall may comprise part of a body portion of the lamina sheet, and, in some embodiments, a distal portion of each inner wall extends away from the body portion in a manner such that each distal portion is perpendicular to the limiting element and parallel to each other, and wherein each distal portion comprises a fulcrum hole, each fulcrum hole being aligned with an opposing fulcrum hole and adaptably sized to receive a fulcrum pin of a toilet flush system actuator unit. In further embodiments, the distal portion of each inner wall may include a flange. In some embodiments the flange is configured to enclose at least a portion of the fulcrum pin when the fulcrum pin is received into the fulcrum hole.

Also disclosed is a fulcrum element for repair of a toilet flush system, comprising at least one fulcrum piece associated with the fulcrum element, the at least one fulcrum piece having a fulcrum hole adaptably sized to receive a fulcrum pin of a toilet flush system actuator unit, and at least one retention piece configured to secure the fulcrum element to a toilet flush valve body, wherein the fulcrum element may be secured and/or removably mounted on the toilet flush valve body.

In some embodiments the fulcrum element is configured to be removably mounted on the toilet flush valve body by sliding the retention piece(s) over respective support arm(s) of the toilet flush valve body, and is further configured such that when the fulcrum element is mounted on the toilet flush valve body an inner wall of the at least one retention piece is configured to closely follow a profile of a portion of a respective support arm of the toilet flush valve body to provide fulcrum holes for receiving respective fulcrum pins of the toilet flush system actuator unit. In some embodiments, the at least one retention piece is configured to grip a portion of at least one support arm of a toilet flush valve body to secure the limiting element to a toilet flush valve body. In further embodiments, the fulcrum element may also comprise a flange associated with the fulcrum piece, the flange being configured to enclose at least a portion of the fulcrum pin when the fulcrum pin is received into the fulcrum hole. The fulcrum element may also comprise a limiting face configured to limit a movement of a stop arm of a toilet flush system actuator unit.

Similar in construction to the limiting element, the fulcrum element may be formed from a lamina sheet. In these embodiments the fulcrum element comprises: a) two retention arms each formed from the ends of the lamina sheet, the retention arms each comprising an inner wall, wherein each inner wall is parallel and facing an opposing inner wall, and wherein a distal portion of each inner wall extends away from a body portion of the lamina sheet in a manner such that each distal portion is perpendicular to the limiting element and parallel to each other, an outer wall, a rear edge, and a front edge, the front edge terminating at an edge of the lamina sheet; and b) a bridge surface formed from a middle portion of the lamina sheet. In these embodiments the fulcrum element is preferably configured to be removably mounted on the toilet flush valve body by sliding the two retention arms over respective support arms of the toilet flush valve body, and is further configured such that when the fulcrum element is mounted on the toilet flush valve body each of the two retention arms substantially surround a portion of a respective support arm and a face of the bridge surface is substantially flush against a portion of a bridge material of the toilet flush valve body disposed between the two support arms and the bridge material is substantially tightly sandwiched between the face of the bridge surface and the front edge of each retention arm. Each distal portion of each inner wall further comprises a fulcrum hole, each fulcrum hole being aligned with an opposing fulcrum hole and adaptably sized to receive a fulcrum pin of a toilet flush system actuator unit.

Also disclosed is a toilet valve repair element formed from a single lamina sheet, comprising: a) two retention arms each formed from the ends of the lamina sheet, the retention arms each comprising: an inner wall, wherein each inner wall is parallel and facing an opposing inner wall, an outer wall, a rear edge, and a front edge, the front edge terminating at an edge of the lamina sheet; and b) a bridge surface formed from a middle portion of the lamina sheet. The limiting element may be configured to be removably mounted on the toilet flush valve body by sliding the two retention arms over respective support arms of the toilet flush valve body, and may be further configured such that when the limiting element is mounted on the toilet flush valve body each of the two retention arms substantially surround a portion of a respective support arm and a face of the bridge surface is substantially flush against a portion of a bridge material of the toilet flush valve body disposed between the two support arms and the bridge material is substantially tightly sandwiched between the face of the bridge surface and the front edge of each retention arm. In some embodiments each inner wall is configured to closely follow a profile of a portion of a respective support arm of the toilet flush valve body to provide fulcrum holes for receiving respective fulcrum pins of the toilet flush system actuator unit.

In accordance with the device of the present invention the limiting element and the fulcrum element are representative of a replacement fitting used to provide for efficient repair of a toilet flush system. The replacement fitting fits snugly onto a toilet flush valve body by its retention arms congruently wrapping around the base of the support arms of the toilet flush valve body. In some embodiments the replacement fitting further comprises projections that rise up flush against the inner walls of the support arms of the toilet flush valve body and wherein the projections closely follow the profile of the support arms.

In some embodiments the device comprises holes on the projecting arms wherein the location of the holes on the said embodiments are concentric and co-located with the fulcrum holes on the support arms of a toilet valve body when said embodiments are snug fitted onto the toilet flush valve body, such that the projecting arms would assume the function of the support arms while providing the fulcrum holes for the toilet flush tilt valve in the event of missing or broken support arms.

In those embodiments wherein the device is formed from a lamina material the device may further comprise a lamina bridge material, wherein the bridge material connects the inner walls of the device that wrap around the base of the support arms of the toilet valve body, and wherein the lamina bridge material is flush against the bridge material connecting the support arms of the toilet flush valve body when said invention is fitted onto the said support arms of the flush valve body. The top edge of the lamina bridge material may be level with the crown of a stop tab which is part of the bridge material between the support arms of the toilet flush valve body, such that the stop arm of the toilet flush system actuator unit that pivots in the fulcrum holes on the support arms will strike the said lamina bridge material in the absence or breakage of the stop tab on the flush valve body. The device may also comprise two lamina arms that firmly wrap around the front of the base of the support arms of the toilet flush valve body when said invention is fitted snugly onto the valve body, such that the device is held firmly in place, laterally, by the clamping hold exerted on the bridge material between the support arms by the lamina bridge material and the two wrap around arms at front of the support arms base together with the close fitting wrap around sections at the base of the support arms.

It is, of course, not necessary that the invention be comprised of a lamina sheet material. For instance, the device can be formed from a single piece of plastic or other materials to accomplish the objective of the invention. The device may consist of a single component part or multiple component parts. The device may also be manufactured from a process of progressive die stamping of sheet metal. In such embodiments the uniform sheet metal thickness is preferably limited to a maximum that allows free sliding movement between the support arms and shoulders at the end of the fulcrum pins on toilet flush system actuator unit of the toilet flush system, when the actuator unit revolves about its fulcrum pins. The sheet metal may be stainless steel or any other metal suitably pliable and rigid to carry out the objective of the present invention. The material of the invention is preferably constructed of a strong corrosion resistant material.

DETAILED DESCRIPTION OF THE PREFERRED EMBODIMENTS

Figure 1A:
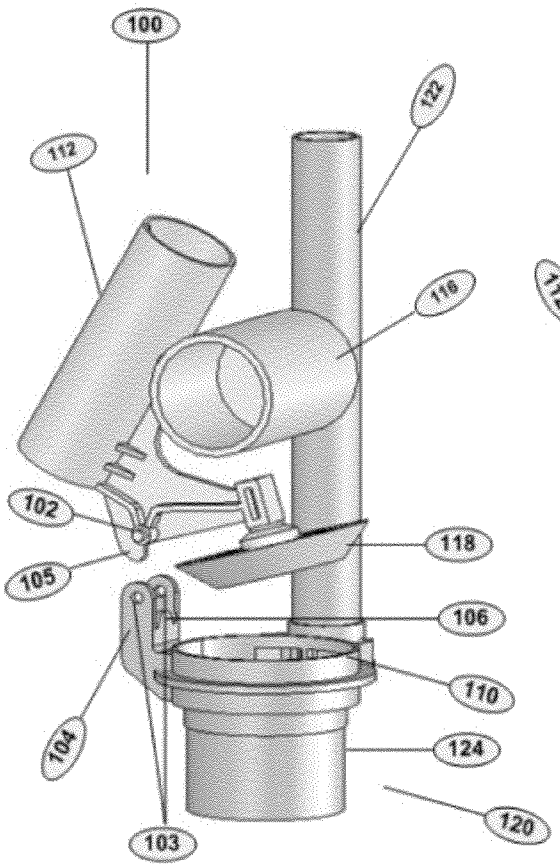
FIG. 1A is a perspective view of a toilet flush valve assembly.

The present invention relates to the field of toilet flush systems and more particularly to a snug fit replacement fitting that assumes the functions of the support arms and/or the stop tab that is integral to the valve body of a toilet flush system, when said components are broken or damaged. The replacement fitting allows a quick repair by replacing the loss of function of the broken support arm and/or the stop tab and thereby avoiding a costly and time-consuming replacement of the entire valve assembly. An exemplary toilet flush system is depicted in the drawings to aid in the description of the present invention, but it is to be understood that the utility of the present invention extends to all applicable toilet flush systems and is not limited to those depicted in the drawings.

FIG. 1A depicts a toilet flush valve assembly having an actuator unit 100 that seals the water in the toilet tank when in closed position with the sealing disc 118 seated on the seat of the valve body 110. Actuator unit 100 is mounted on the valve body 120 by means of the fulcrum pins 102 riding in the fulcrum holes 103 such that actuator unit 100 is free to tilt about fulcrum holes 103. This enables actuator unit 100 to hold the water in the toilet tank when in closed position and allows flushing water through the discharge tube 124 by tilting open about its fulcrum. The entire flush valve assembly is mounted in the toilet tank (not shown) by means of the externally threaded discharge tube 124 passing through the center hole at the bottom of the toilet tank and secured from the external bottom of the toilet tank by a nut. A sealing gasket sandwiched between the top collar of the discharge tube and the toilet tank bottom ensures that water does not leak from the bottom hole of the tank. The toilet tank with the toilet flush valve secured on the bottom of the tank is then securely mounted on the toilet (not shown) with the discharge tube 124 of the flush valve aligned with the hole for flushing water on the top face of the toilet.

Figure 1B:
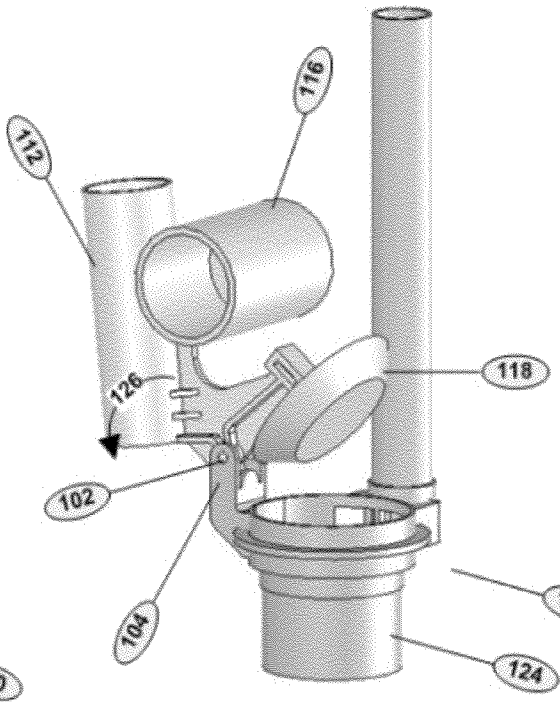
FIG. 1B is an elevated perspective side view of a toilet flush valve assembly.
Figure 1C:
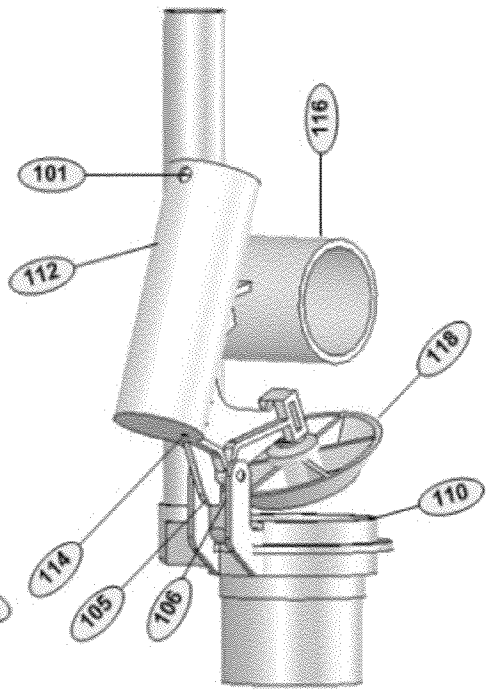
FIG. 1C is a perspective, rear view of a toilet flush valve assembly.

FIG. 1B depicts the actuator unit 100 tilted fully open with the sealing disc 118 lifted off the seat on the valve body 120 thus enabling water to flow through the discharge tube 124 and flush the toilet. Note that actuator unit 100 is held open at the beginning of the flush by the weight of water in the open cylinder 112 exerting a counterclockwise moment 126 about the fulcrum pins 102, greater than the clockwise moment exerted by the combination of the counterweight 116 and sealing disc 118. FIG. 1C depicts a rear view of the flush valve assembly. As water drains from the small hole 114 at the bottom of the cylinder 112, the tilted valve actuator 100 loses its equilibrium and the weight of the counterweight 116 and sealing disc 118 forces actuator 100 to tilt back in a clockwise direction to seal off the seat 110.

As depicted by FIG. 1C, stop arm 105 butts against the stop tab 106, preventing actuator unit 100 from counter-rotating beyond vertical. This is necessary for the actuator unit 100 to be able to rotate back to a closed position at the end of the flush. Hole 101 on open cylinder 112 of actuator unit 100 receives the chain from the toilet flush lever (not shown) that pulls the actuator unit 100 counterclockwise, pivoting it about fulcrum holes 103. The small hole 114 at the bottom of open cylinder 112 drains water in the cylinder as the water level in the toilet tank lowers during the flushing of the toilet. Actuator unit 100, tilted and held fully open by the weight of the water in open cylinder 112 at the beginning of the flush, loses its equilibrium as open cylinder 112 loses the water through the bottom hole 114, and the combined weight of the counter weight 116 and sealing disc 118 exert a clockwise turning moment about the fulcrum pins 102 causing actuator unit 100 to tilt forward and seal off the flushing water with the sealing disc 118 seated on the seat 110 of the flush valve body 120.

Figure 3:
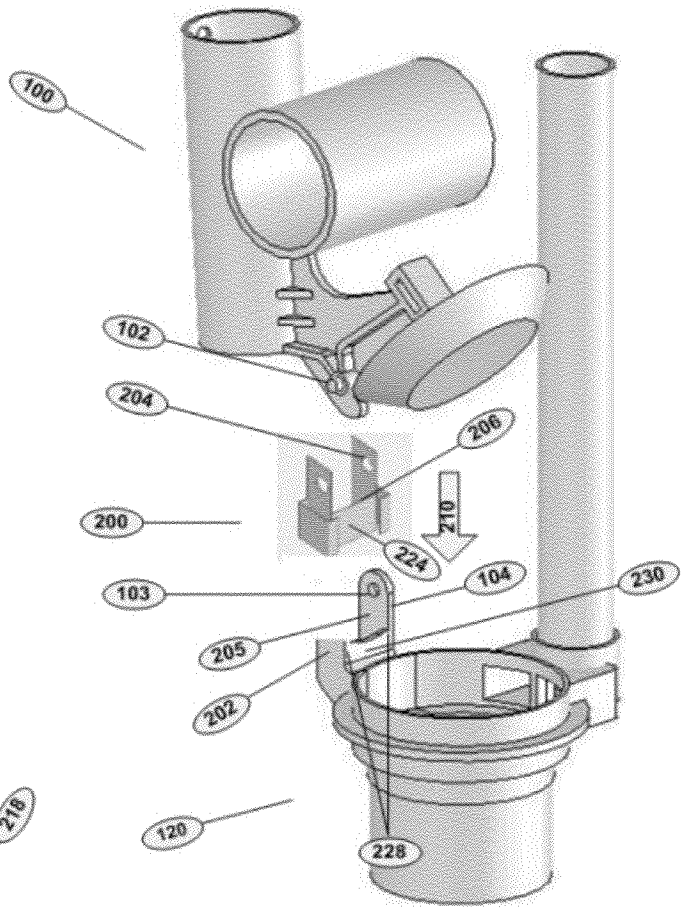
FIG. 3 is an exploded view of the replacement fitting device being installed on a damaged toilet flush valve assembly.

FIG. 3 illustrates the flush valve assembly of FIG. 1 with a broken stop tab 106 (see FIG. 1) and a broken support arm 202. Where such breakage occurs, the prior art response is to replace the entire flush valve assembly. It is the object of the present invention to avoid replacing the entire assembly using a replacement fitting that obviates the need to replace the assembly.

Figure 2A:
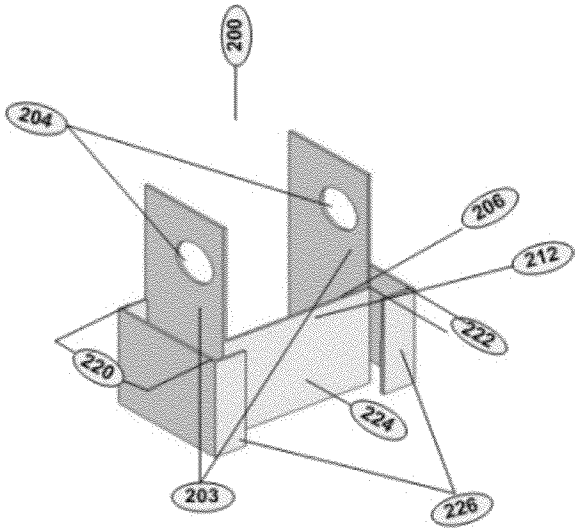
FIG. 2A is an elevated, perspective view of a first preferred embodiment of a replacement fitting device of the present invention.

Turning to FIG. 2A, a preferred embodiment of the present invention is a replacement fitting 200 that quickly and effectively assumes the functions of damaged and/or broken support arm(s) 104 or stop tab 106 on the toilet flush valve body 120. Replacement fitting 200 preferably comprises a thin plate or sheet or lamina 201, and is preferably fabricated from stainless steel sheet metal, but it can be fabricated of various other materials such as but not limited to aluminum, tin, zinc, copper, metal alloys, polymers (plastics), etc. as long as the material has the necessary strength, high corrosion resistance, and formability, and is impervious to prolonged immersion in water. Progressive die stamping in the case of sheet metal and injection molding in the case of plastic is preferred but not limited to in manufacturing the replacement fitting 200. Furthermore, the edges on the replacement fitting 200 may be lined with a smooth material such as, but not limited to, nylon to enable ease of handling and lessen the friction in the fulcrum holes.

Figure 2B:
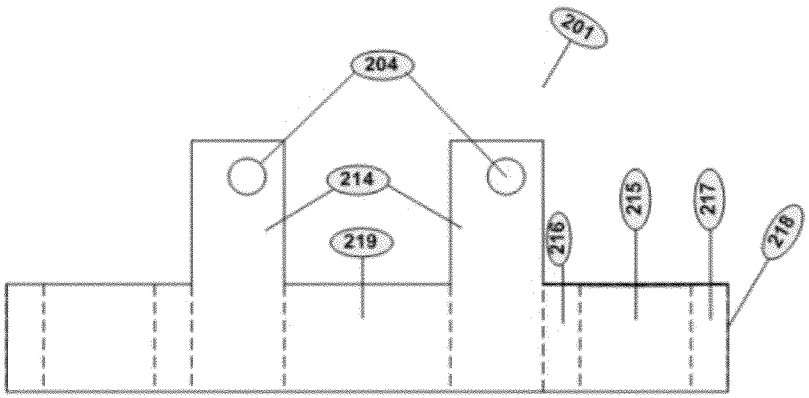
FIG. 2B is a plan view of an unfolded sheet used to construct the embodiment of FIG. 2A.

FIG. 2B depicts a precut lamina sheet to be formed using the die stamping or other similar forming process. Using die stamping the lamina sheet may be folded in a manner such that the limiting element comprises two retention arms 226 each formed from the ends of the lamina sheet 201, the retention arms each comprising: an inner wall 214, an outer wall 215, a rear edge 216, and a front edge 217, the front edge 217 terminating at an edge 218 of the lamina sheet 201, and a bridge surface 219, 224 formed from a middle portion of lamina sheet 201. Fulcrum holes 204 are shown precut in the lamina sheet 201. After replacement fitting 200 has been formed, each inner wall is parallel and facing an opposing inner wall as depicted in FIG. 2A. It should be noted that bridge surface 219 may be cut shorter in height if its height would interfere with the operation of the flush valve actuator unit 100 when mounted on valve body 120, if fulcrum operation is the only object to be achieved by mounting replacement fitting 200 to flush valve 120. It should be noted that the height of the bridge surface 219 would not be expected to exceed the height of the stop tab 106 on the valve body 120 (see FIG. 1A).

It is not necessary that both retention arms be included in the device to achieve the objective of the invention. The device may be configured to include only one retention arm having an extended inner wall or other means for providing a fulcrum hole 204 for retaining a fulcrum pin 102, as long as the valve body 120 is firmly and operationally secured. Where only one retention arm is employed, the device can be placed, for example, over a single broken support arm 202 of the damaged flush valve assembly to secure the replacement fitting 200 from tilting freely from side to side, about fulcrum pins 102.

As depicted by FIG. 3, replacement fitting 200 is designed to be easily snug fitted onto the valve body 120 of a toilet flush valve assembly if and when the support arm(s) 104 and/or stop tab 106 break, enabling the flush valve to operate with the same efficiency before the breakage. This is achieved by unhinging actuator unit 100 from its location on fulcrum holes 103 of the support arm(s) 104 and pushing on the replacement fitting 200 to fit snugly over and onto the support arm(s) or whatever stubs 202 are left in the case of broken support arms 104. With the replacement fitting 200 snugly fitted on to the support arm(s) 104, 202, actuator unit 100 is again mounted onto new fulcrum holes 204 on the replacement fitting 200 and the unit is ready for service. This quick and efficient repair utilizing the replacement fitting 200 avoids replacing the whole flush valve body 120 that can be costly and time consuming.

Replacement fitting 200 is configured to be snugly push fitted over the remaining stubs 202 of the broken support arms provide support arms 203 with fulcrum holes 204 and stop tab 212 to replace the damaged components on the valve body 120 as shown by FIG. 3. Two vertical arms 203 containing the fulcrum holes 204 project upward from replacement fitting 200 as shown by FIG. 2A. These two vertical arms 203 bear flat against the inner faces 205 of the support arms 104 and the top edge 206 of the bridge surface 224 is approximately level with the crown of stop tab 106 and fulcrum holes 204 are concentric with the fulcrum holes 103 on support arms 104 when the replacement fitting 200 is push fitted down (see arrow 210) to the base of the support arms. Replacement fitting 200 provides fulcrum holes 204 and stop tab 212 function as depicted in FIG. 4. Replacement fitting 200 is constructed of a strong, durable, and highly corrosion resistant material with a preferably uniform thickness. The thickness is preferably thin such that when actuator unit 100 is mounted on fulcrum holes 204 the two vertical arms 203 do not impinge on actuator unit 100 such as to prevent it from tilting freely about fulcrum pins 102.

Figure 4B:
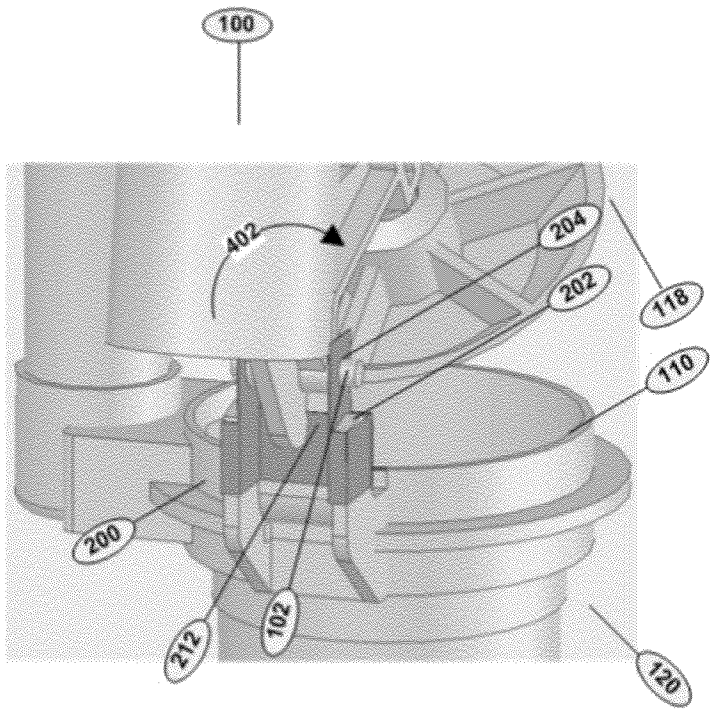
FIG. 4B is an enlarged, elevated perspective view of the replacement fitting of FIG. 2 mounted on the damaged toilet flush valve assembly of FIG. 3.
Figure 4A:
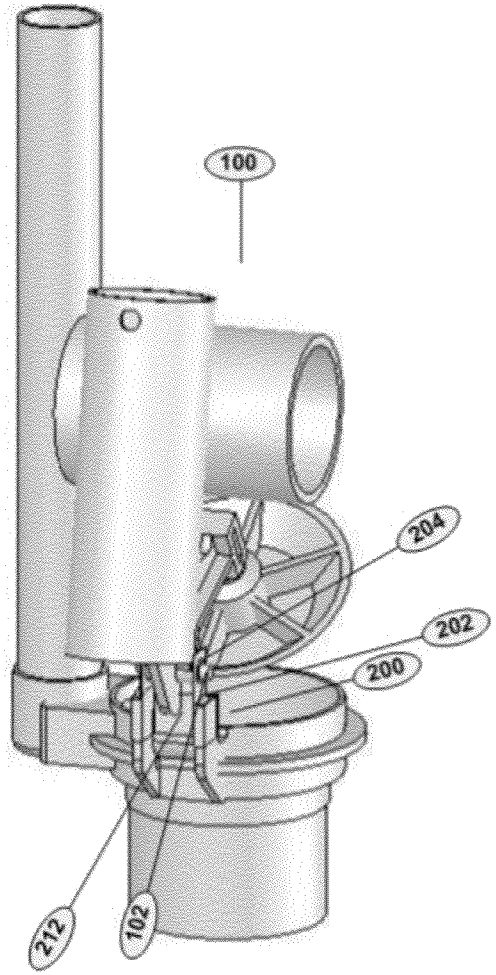
FIG. 4A is a perspective view of the replacement fitting of FIG. 2 mounted on the damaged toilet flush valve assembly of FIG. 3.

FIGS. 4A-4B illustrate the replacement fitting 200 taking over the functions of one or more broken support arm(s) 104. Replacement fitting 200 is shown mounted over support arms 104 or their stubs in the case of a broken support arm to provide the fulcrum holes 204 for fulcrum pins 102 of actuator unit 100 to revolve. FIG. 4A illustrates replacement fitting 200 snugly fitted onto the stubs 202 of the broken support arms. Replacement fitting 200 provides fulcrum holes 204 for the actuator unit 100 to be mounted. Replacement fitting 200 also provides a stop tab 212 for stop tab function for actuator unit 100 in the same way as the original stop tab 106 (FIG. 1A-1C). The length 220 and width 222 of the two channels in replacement fitting 200 (FIG. 2A) are slightly larger than the cross section of support arms 104, 202, providing a snug fit when replacement fitting 200 is mounted onto them. The height of the face 224 on replacement fitting 200 is made approximately the same as that of the stop tab 106 to provide the stopping function for actuator unit 100 in the event where the stop tab 106 is broken off as depicted by FIG. 3. The arms 226 on the replacement fitting 200 are wrapped around the front part of the base 228 of the support arms 104 (FIG. 3), thus securely attaching the replacement fitting 200 to the flush valve body 120. The bridge material 230 connecting the two support arms at their base is sandwiched between the face 224 and the arms 226 of the replacement fitting 200, further providing a more secure attachment of replacement fitting 200 to the flush valve body 120.

FIG. 4B demonstrates the actuator unit 100, revolving in a clockwise direction 402 about fulcrum pins 102 in fulcrum holes 204 on replacement fitting 200, about to seal off the seat 110 on the valve body 120 with the sealing disc 118.

Figure 5A:
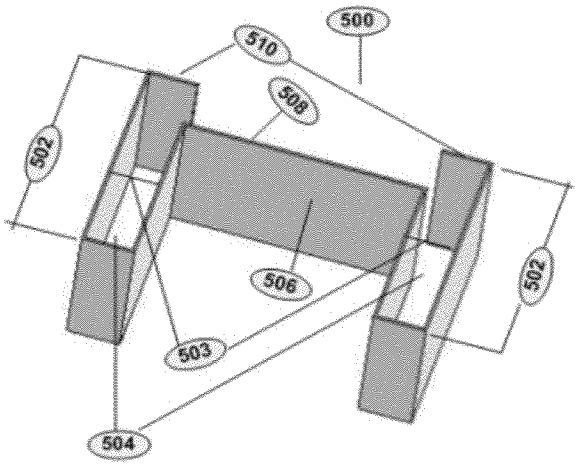
FIG. 5A is an elevated, perspective view of a second preferred embodiment of a replacement fitting of the present invention.

In the situation where only the stop tab is broken, the replacement fitting of the present invention may be mounted over the support arms. FIG. 5A depicts the configuration of an short replacement fitting 500 without support arms 203 and fulcrum holes 204. In the illustrated embodiment, the short replacement fitting 500 has a face 506 which may function as a new stop tab, and retention arms, including channels 504. Similar to replacement fitting 200, length 502 and width 503 of the two channels 504 in the short replacement fitting 500 are sized to provide a snug fit on the cross section of the support arms 104 of the valve body 120. With the short replacement fitting 500 push fitted onto support arms 104 down to their base, the face 506 bears flat against the backside of the bridge material 230 between support arms 104 and the top side 508 of face 506 is level with the crown of stop tab 106. Bridge material 230 between support arms 104 is tightly sandwiched between face 506 and arms 510 of replacement fitting 500. The face 506 provides the stopping function in the case of a broken stop tab as discussed in the prior embodiment. Short replacement fitting 500 is formed of a strong, durable, and highly corrosion resistant material and of a preferably thin uniform thickness.

Figure 5B:
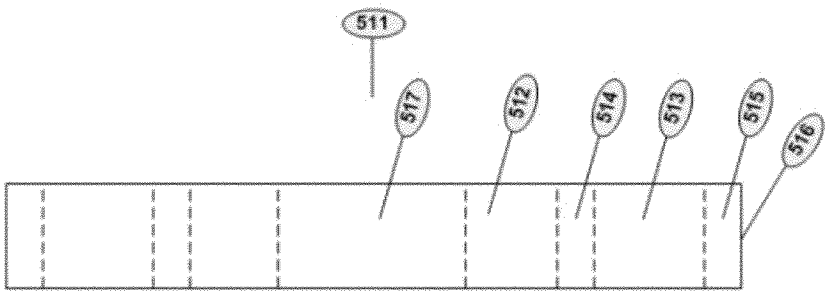
FIG. 5B is a plan view of an unfolded sheet used to construct the embodiment of FIG. 5A.

FIG. 5B depicts a precut lamina sheet 511 for forming the short replacement fitting 500. Using a die stamping method or other forming process the lamina sheet may be folded in a manner similar to that described above in connection with FIG. 2B. However, precutting the lamina prior to the forming process is much simpler due to the lack of an extended inner wall sections 214 and/or fulcrum holes 204. Lamina sheet 511 needs only to include enough material to form two retention arms with an inner wall 512, an outer wall 513, a rear edge 514, and a front edge 515, the front edge 515 terminating at an edge of the lamina sheet 516, and a bridge surface 517, 506 formed from a middle portion of lamina sheet 511. It should be noted that bridge surface 517 would preferably not be shaped to have an upper surface higher than the stop tab 106 so as not to interfere with the operation of the flush valve actuator unit 100 when mounted on valve body 120.

FIG. 6 depicts a flush valve assembly with a broken stop tab 106 (FIG. 1) on the valve body 120. This condition would allow the actuator unit 100 to tilt all the way over and prevent it from tilting back to the closed position at the end of the flush. Actuator unit 100 is shown unhinged from fulcrum holes 103 in support arms 104. Replacement fitting 500 is mounted on the support arms. Once the replacement fitting 500 is snugly fitted over the support arms, it provides the stopping function of the missing stop tab.

Figure 6A:
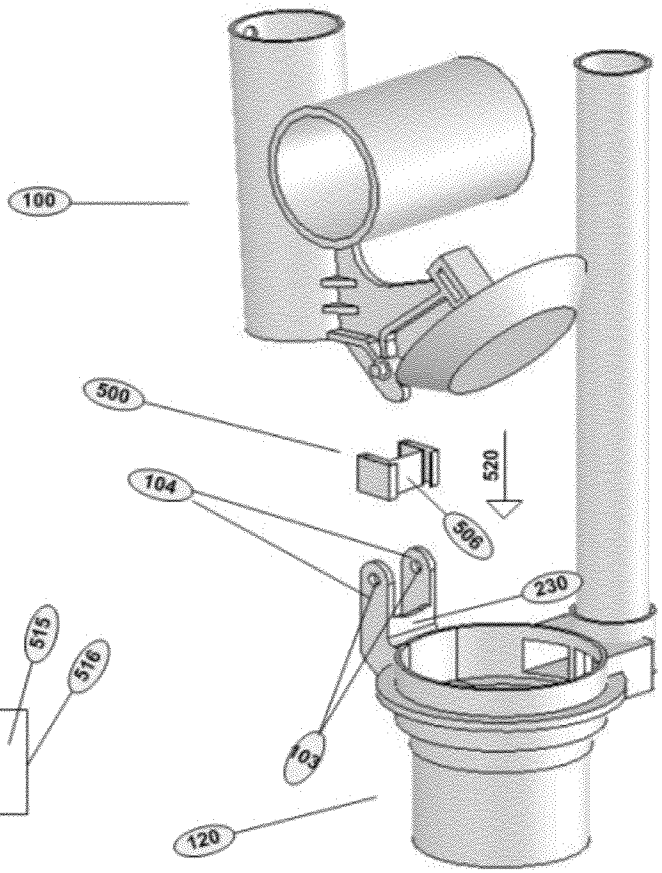
FIG. 6A is an exploded, elevated, perspective view of the embodiment of FIG. 5A being installed on a damaged toilet flush valve assembly.
Figure 6B:
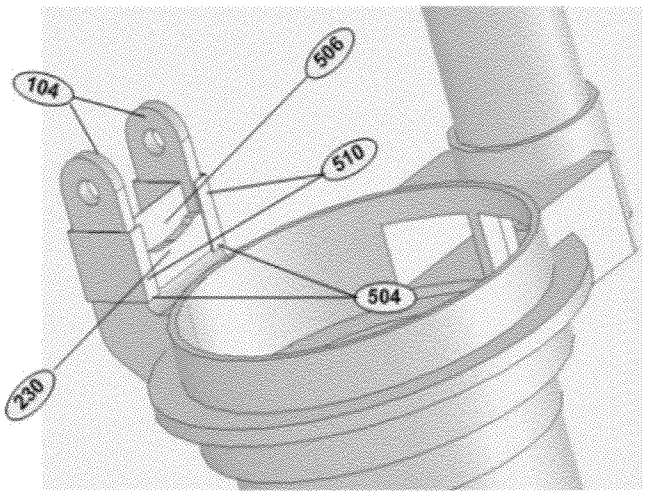
FIG. 6B is an enlarged, elevated perspective view of the embodiment of FIG. 5A mounted on the damaged toilet flush valve assembly.

In one method of operating the present invention, replacement fitting 500 is slid in a downward direction 520 over support arms 104 from above. FIG. 6A illustrates the short replacement fitting 500 starting to be inserted over support arms 104. FIG. 6B illustrates the replacement fitting 500 at the end of its descent with face 506 of replacement fitting 500 flush against the backside of bridge 230 between the two support arms 104. Replacement fitting 500 is also shown at the bottom of its travel with the bridge material 230 between support arms 104 tightly sandwiched between face 506 and arms 510. The bottom edges of the arms 504 have bottomed out at the base of the support arms 104 and replacement fitting 500 is securely wrapped around the support arms 104. Arms 510 are also bearing against the front part of the support arms 104, thus ensuring a firm grip of replacement fitting 500 on support arms 104. The face 506 serves to replace the broken stop tab 106. Although the method of operating the present invention has been illustrated in the above description using short replacement fitting 500, it should be understood that the replacement fitting 200 would mount in the same manner.

Figure 7:
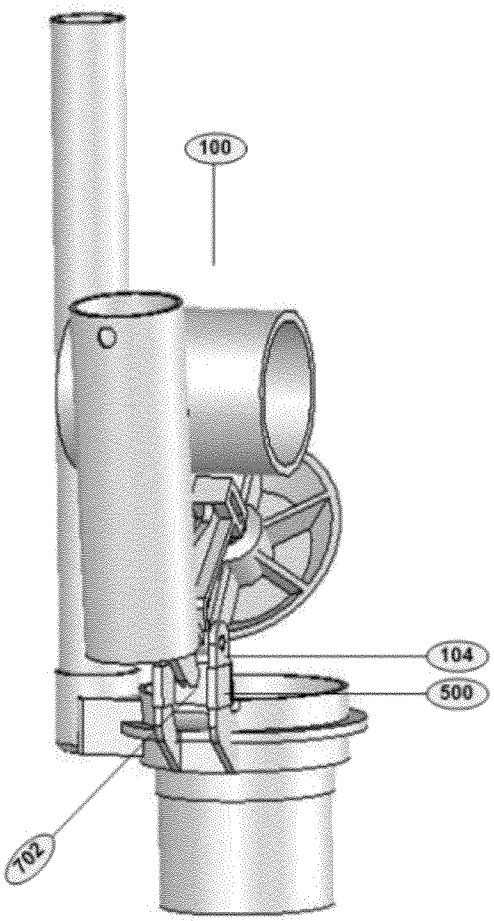
FIG. 7 is a perspective view of the embodiment of FIG. 5A mounted on a broken valve assembly of FIG. 6A.

FIG. 7 depicts replacement fitting 500 in use, snugly fitted over support arms 104 and providing the stopping function of the missing stop tab. Replacement fitting 500 is mounted over support arms 104 and providing the stop at the point of contact 702 for actuator unit 100, thus preventing it from tilting all the way back beyond its designed limit. In a scenario where one or both support arms 104 and/or a stop tab 106 are broken off, replacement fitting 200 is mounted over the remaining support arm stubs 202.

Figure 8:
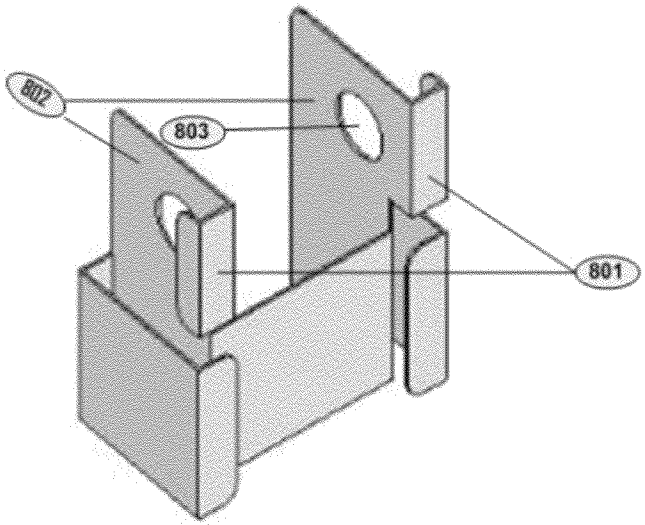
FIG. 8 is an elevated, perspective view of a third preferred embodiment of a replacement fitting of the present invention.
Figure 9:
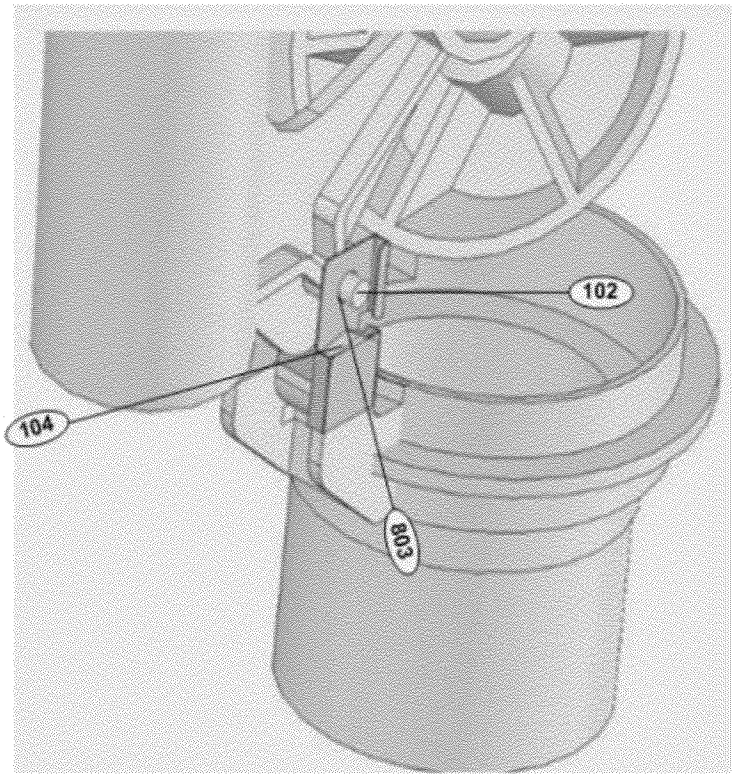
FIG. 9 is an elevated perspective view of the embodiment of FIG. 8 mounted on the damaged toilet flush valve assembly.

FIG. 8-9 show an alternative embodiment of replacement fitting 200 that can be employed without departing from present invention and its intended utility functions. The device comprises a flange 801 associated with the fulcrum piece 802. In this embodiment, the flange 801 is configured to provide better rigidity of the fulcrum pieces 802 when the fulcrum pin 102 is received into fulcrum hole 803. This embodiment is illustrated in FIG. 9 in use on a broken support arm(s) 104.

Because of its shape and adaptability, replacement fitting 200 may be utilized to remedy even the most extreme cases, such as where both support arms 104 and stop tab 106 are broken. In these cases, actuator unit 100 is prevented from being mounted as a result of missing fulcrum holes 103 for the fulcrum pins 102 and actuator unit 100 is not prevented from tilting all the way over because stop tab 106 will also be missing. Nonetheless, the utilization of replacement fitting 200 will restore functionality by providing new support arms 203 and fulcrum holes 204 to support the fulcrum pins 102 of actuator unit 100, or a entirely new or different actuator unit similarly configured. The objective is to allow a fast and easy repair of toilet flush valves without requiring the toilet tank to be dismounted from the toilet and a new flush valve body 120, including overflow pipe 122, to be installed.

Although the above descriptions of the present invention demonstrates the repair of a specific valve flush assembly, it is apparent to one with ordinary skills in the art that variations in choice of materials, sizes, and shapes can be employed without departing from the inventive concept of the said invention to repair similar broken support arms and stop tabs on all applicable toilet flush systems.

The forgoing description for the preferred embodiments of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto. Although the present invention has been described in detail with regard to the preferred embodiments and drawings thereof, it should be apparent to those of ordinary skill in the art that various adaptations and modifications of the present invention may be accomplished without departing from the spirit and the scope of the invention. Accordingly, it is to be understood that the detailed description and the accompanying drawings as set forth hereinabove are not intended to limit the breadth of the present invention

We claim:

1. A fulcrum element for repair of a toilet flush system, comprising:

at least one fulcrum piece associated with the fulcrum element, the at least one fulcrum piece having a fulcrum hole adaptably sized to receive a fulcrum pin of a toilet flush system actuator unit, and at least one retention piece configured to mount the fulcrum element to a toilet flush valve body and wherein the fulcrum element is formed from a single lamina sheet, comprising:

two retention arms each formed from the ends of the lamina sheet, the retention arms each comprising an inner wall, wherein each inner wall is parallel and facing an opposing inner wall, and wherein a distal portion of each inner wall extends away from a body portion of the lamina sheet in a manner such that each distal portion is perpendicular to the fulcrum element and parallel to each other; an outer wall, a rear edge, and a front edge, the front edge terminating at an end of the lamina sheet; and a bridge surface formed from a middle portion of the lamina sheet, wherein the fulcrum element is configured to be mounted on the toilet flush valve body by sliding the two retention arms over respective support arms of the toilet flush valve body, and is further configured such that when the fulcrum element is mounted on the toilet flush valve body each of the two retention arms substantially surround a portion of a respective support arm and a face of the bridge surface is substantially flush against a portion of a bridge material of the toilet flush valve body disposed between the two support arms and the bridge material is substantially tightly sandwiched between the face of the bridge surface and the front edge of each retention arm, and wherein each distal portion of each inner wall comprises a fulcrum hole, each fulcrum hole being aligned with an opposing fulcrum hole and adaptably sized to receive a fulcrum pin of a toilet flush system actuator unit.

2. The fulcrum element of claim 1, wherein the fulcrum element is configured to be mounted on the toilet flush valve body by sliding two of the at least one retention piece over respective support arms of the toilet flush valve body, and is further configured such that when the fulcrum element is mounted on the toilet flush valve body an inner wall of the at least one retention piece is configured to closely follow a profile of a portion of a respective support arm of the toilet flush valve body to provide fulcrum holes for receiving respective fulcrum pins of the toilet flush system actuator unit.

3. The fulcrum element of claim 1, wherein the at least one retention piece is configured to grip a portion of at least one support arm of a toilet flush valve body to mount the fulcrum element to a toilet flush valve body.

4. The fulcrum element of claim 3, further comprising:

a flange associated with the fulcrum piece, the flange being configured to enclose at least a portion of the fulcrum pin when the fulcrum pin is received into the fulcrum hole.

5. The fulcrum element of claim 1, further comprising:

a limiting face configured to limit a movement of a stop arm of a toilet flush system actuator unit.

* * * * *